US010925367B2

(12) United States Patent
Loose

(10) Patent No.: US 10,925,367 B2
(45) Date of Patent: Feb. 23, 2021

(54) HAIR STYLING DEVICE AND METHOD OF FORMING THE SAME

(71) Applicant: Joe Loose, Novi, MI (US)

(72) Inventor: Joe Loose, Novi, MI (US)

(73) Assignee: Joe Loose, Novi, MI (US)

( * ) Notice: Subject to any disclaimer, the term of this patent is extended or adjusted under 35 U.S.C. 154(b) by 110 days.

(21) Appl. No.: 15/984,535

(22) Filed: May 21, 2018

(65) Prior Publication Data

US 2019/0045900 A1 Feb. 14, 2019

Related U.S. Application Data

(60) Provisional application No. 62/543,601, filed on Aug. 10, 2017.

(51) Int. Cl.

| | |
|---|---|
| ***A45D 1/04*** | (2006.01) |
| ***A45D 20/10*** | (2006.01) |
| ***A46D 1/00*** | (2006.01) |
| ***A45D 2/00*** | (2006.01) |
| ***A45D 20/12*** | (2006.01) |
| ***A45D 24/00*** | (2006.01) |
| *A45D 1/00* | (2006.01) |

(52) U.S. Cl.

CPC ..... *A45D 1/04* (2013.01); *A45D 2/00* (2013.01); *A45D 20/10* (2013.01); *A45D 20/12* (2013.01); *A45D 24/00* (2013.01); *A46D 1/00* (2013.01); *A45D 2001/004* (2013.01); *A45D 2002/003* (2013.01); *A46B 2200/104* (2013.01)

(58) Field of Classification Search

CPC ..... A45D 2001/004; A45D 1/04

See application file for complete search history.

(56) References Cited

U.S. PATENT DOCUMENTS

| | | | | |
|---|---|---|---|---|
| 7,308,899 | B2 | 12/2007 | Kampel | |
| 8,875,717 | B2 * | 11/2014 | Murzynski | A45D 24/00 132/163 |
| 9,913,519 | B2 * | 3/2018 | Shami | A45D 1/04 |
| 2007/0029302 | A1 | 2/2007 | Russo | |
| 2016/0325994 | A1 * | 11/2016 | Qu | C01B 21/0648 |
| 2018/0291974 | A1 * | 10/2018 | Kesavan | F16D 69/026 |
| 2018/0327611 | A1 * | 11/2018 | Scheffer | C09D 11/037 |
| 2019/0309205 | A1 * | 10/2019 | Guo | C08L 69/00 |

OTHER PUBLICATIONS

Li et al., Electronic and Optical Properties of Graphene Quantum Dots: The Role of Many-Body Effects, Jan. 15, 2015, available at https://pubs.acs.org/doi/10.1021/jp506969r (Year: 2015).*

XG Sciences, About XGNP® Graphene Nanoplatelets, Mar. 29, 2015, available at https://web.archive.org/web/20150329171421/http://xgsciences.com/products/graphene-nanoplatelets/ (Year: 2015).*

(Continued)

*Primary Examiner* — Michael McCullough

(74) *Attorney, Agent, or Firm* — Dickinson Wright PLLC

(57) ABSTRACT

A hair styling device comprising: a styling substrate; and a coating disposed onto the styling substrate, the coating including: one or more ceramic minerals, and one or more graphene materials in a sufficient amount so that the coating has a thermal conductivity of about 7 Watts/(meter·Kelvin).

20 Claims, 5 Drawing Sheets

(56) References Cited

OTHER PUBLICATIONS

Angstron Materials, *Technical Data Sheet—Product: N006-P Nano Graphene Platelets*, Apr. 28, 2015.
Angstron Materials, *Technical Data Sheet—Product N002-PDR*, Apr. 1, 2014.
*xGnP® Graphene Nanoplatelets Grade C Safety Data Sheet*, Nov. 26, 2015.
*xGnP® Graphene Nanoplatelets Grade M Safety Data Sheet*, Nov. 26, 2015.

* cited by examiner

HAIR STYLING DEVICE AND METHOD OF FORMING THE SAME

FIELD

The present teachings relate to a hair styling device that includes a coating comprised of one or more graphene materials in a sufficient amount so that the coating has a thermal conductivity of about 7 Watts/(meter·Kelvin).

BACKGROUND

Conventional ceramic or resin coated hair styling devices provide better heat distribution, heat retention, and heat transfer characteristics in comparison to non-coated metal styling devices, which are usually made of aluminum or titanium. Current ceramic coatings used for the styling tool industry conduct thermal energy at 1.5 Watts/(meter·Kelvin), which may provide an enhancement in performance over such non-coated metal styling tools. Tourmaline may be added to the ceramic or resin coated hair styling devices in an attempt to reduce static or "frizzy" hair (where individual hairs repel each other and project away from the main body of hair) results.

During use, self-heating ceramic or resin coated hair styling devices such as curling irons and flat irons may take a prolonged amount of time to heat to the optimal temperature for styling hair. Once heated, uneven heat signatures across the coated, thermally conductive styling surface of the device may result, creating gaps in peak temperature. This uneven heat distribution can lead to styled tresses that are damaged or frizzy and, at the very least, require additional applications of the hair styling device to remove the undesired result. Hair styling devices utilizing an external source of heat, such as thermally conductive hair brushes receiving heat from hair dryers, can also cause damage to the hair during styling. Generally, when heat is applied to the surface of the ceramic or resin coated brush, the heat remains localized to the side of the brush that is receiving direct heat from the hair dryer. The localization of high heat may cause damage to the hair as well as failure of the brush bristles. Over time, ceramic and resin coated hair styling devices may chip, which may cause snagging and thus further damage to the hair during use.

Examples of some ceramic and static dissipative hair styling devices are disclosed in U.S. Pat. Nos. 7,308,899; 8,875,717; and U.S. Patent Application Publication No. 2007/0029302, all of which are expressly incorporated herein by reference for all purposes. What is needed is a hair styling device that includes a coating disposed on the styling surface thereof that reaches a peak temperature quickly and instantaneously distributes this desired level of heat across the entire styling surface without suffering from uneven heat signatures that cause damage or additional applications of the styling device to the hair. What is needed is a hair styling device with an improved conductive coating that returns to room temperature more quickly after the heat source is turned off or removed. It would be attractive to have a hair styling device with an improved conductive coating that reduces static electricity, uses graphene material to generate a higher level of strength and thermal conductivity in order to provide improved aesthetic results with less effort thereby improving the longevity of the device.

SUMMARY

The present teachings are predicated upon providing a thermally conductive coating for use on hair styling devices and accessories such as, but not limited to, hair brushes, flat irons, curling irons, hair dryers and dryer attachments. The coating includes one or more graphene materials and one or more ceramic minerals to provide improved aesthetic results of the styled tresses in an efficient manner.

The present teachings include: a hair styling device comprising: a styling substrate; and a coating disposed onto the styling substrate, the coating including: one or more ceramic minerals, and one or more graphene materials in a sufficient amount so that the coating has a thermal conductivity of about 7 Watts/(meter·Kelvin).

The present teachings include: a hair styling device comprising: a styling substrate; and a coating disposed onto the styling substrate, the coating including: (a) one or more ceramic minerals, wherein the ceramic mineral comprises one or more substances selected from the group consisting of silica, alumina, titanium dioxide, zirconia, silicon carbide, ferrous oxide, natrium oxide, potassium oxide, calcium oxide, magnesium oxide, or mixtures thereof; (b) one or more graphene materials present in a sufficient amount so that the coating has a thermal conductivity of about 7 Watts/(meter·Kelvin); (c) one or more anti-static agents; and (d) one or more pigment materials.

The present teachings include: a hair styling device comprising: a styling substrate; and a coating dispersed onto the styling substrate, the coating including: (a) one or more ceramic minerals, wherein the ceramic mineral comprises one or more substances selected from the group consisting of silica, alumina, titanium dioxide, zirconia, silicon carbide, ferrous oxide, natrium oxide, potassium oxide, calcium oxide, magnesium oxide, or mixtures thereof; (b) one or more graphene materials in a sufficient amount so that the coating has a thermal conductivity of about 7 Watts/(meter·Kelvin); (c) one or more pigment materials; and (d) one or more anti-static agents; wherein the coating is disposed onto a heating member or a hair brush.

The present teachings include: a coating for a styling substrate of a hair styling device, the coating including: one or more ceramic minerals, and one or more graphene materials in a sufficient amount so that the coating has a thermal conductivity of about 7 Watts/(meter·Kelvin).

The present teachings include: a method comprising: applying a wet coating to a styling substrate of a hair styling device, the wet coating including: (a) one or more ceramic minerals, wherein the ceramic mineral comprises one or more substances selected from the group consisting of silica, alumina, titanium dioxide, zirconia, silicon carbide, ferrous oxide, natrium oxide, potassium oxide, calcium oxide, magnesium oxide, or mixtures thereof; (b) one or more graphene materials in a sufficient amount so that the coating has a thermal conductivity of about 7 Watts/(meter·Kelvin); (c) one or more pigment materials; (d) one or more anti-static agents; (e) one or more solvents; wherein the wet coating is applied by spraying on, painting, brushing, or an immersion technique; and wherein the curing process is performed at room temperature.

The present teachings provide a hair styling device that includes a coating disposed on the styling surface thereof that reaches a peak temperature quickly and instantaneously distributes this desired level of heat across the entire styling surface without suffering from uneven heat signatures that cause damage or additional applications of the styling device to the hair. The present teachings provide a hair styling device with an improved conductive coating that returns to room temperature more quickly after the heat source is turned off or removed. The present teachings provide a hair styling device with an improved conductive coating that reduces static electricity, uses graphene material to generate a high level of strength and thermal conductivity in order to provide improved aesthetic results with less effort thereby enhancing the longevity of the device.

DETAILED DESCRIPTION

Figure 1:
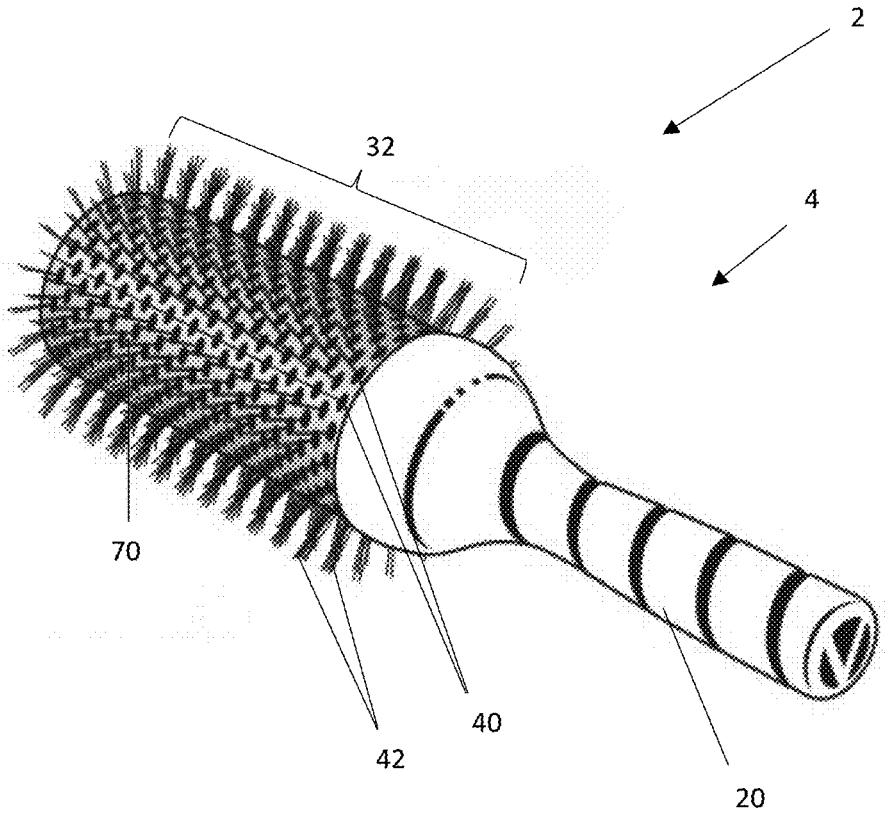
FIG. 1 is a perspective view of a round brush with a coating disposed on the barrel portion thereof.

This application claims the benefit of U.S. 62/543,601 filed on Aug. 10, 2017, the entire disclosure of which is hereby incorporated by reference herein for all purposes.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The teachings herein relate to a hair styling device that functions to assist a user in creating a hair style. The hair styling device may be a hair brush, round brush, flat iron, curling iron, hair dyer, or any other suitable item used to groom or style hair. The hair styling device may include a styling substrate and a coating disposed onto the styling substrate.

The styling substrate and the coating disposed thereon may function to receive and distribute heat across its surface for transfer to hair. The styling substrate may be a heating member, a portion of the hair styling device that receives heat from an internal source such as a heating element housed within the hair styling device itself. The styling substrate may receive heat from an external source (i.e. heat is applied to the styling substrate from a conventional blow dryer). The styling substrate may directly or indirectly contact hair during use. The styling substrate may be composed of any material generally used for hair styling devices that can withstand high temperatures (e.g., a temperature of about 90° C. or more, about 120° C., about 150° C. or more, or about 175° C. or more and about 225° C. or less, or about 200° C. or less) such as thermoplastics, metals, ceramics, or combinations thereof. The styling substrate may be the plates of a flat iron, the barrel of a curling iron, the coils of a hair dryer, the barrel of a round brush, the teeth or bristles of a hair brush or comb, or the brush base of a hair brush. The coating may be one or more layers disposed upon the styling substrate.

The coating may function to distribute heat, evenly distribute heat across a styling substrate, protect hair, prevent contaminants from collecting upon the styling substrate, or a combination thereof. The coating may be disposed as a single layer. The coating may be a plurality of layers. The coating may be applied directly to the styling substrate. The coating disposed onto the styling substrate may include one or more ceramic minerals, one or more graphene materials, one or more anti-static agents, one or more pigment materials, one or more solvents, or a combination thereof. The coating may be applied to the styling substrate using any method disclosed herein including spray coating, painting, brushing, dipping, rolling, air knife application, curtain coating, or immersion techniques. Spray coating techniques may include air spray, high volume low pressure (HVLP) spray, air-assisted, airless, or electrostatic atomization. Curing may occur at room temperature for a minimum two hours before safe handling (e.g., disrupting the coating), and may require an additional 24 hours or more, 36 hours or more, or 48 hours or less to cure completely. The coating applied to the styling substrate as cured may have a thickness of about 10 microns or more, preferably about 20 microns or more, or more preferably about 30 microns or more. The coating applied to the styling substrate as cured may have a thickness of about 120 microns or less, preferably about 100 microns or less, or more preferably about 90 microns or less (i.e., in an amount of between about 30 microns and about 90 microns). The coating may contain one or more solvents such as alcohol or water, which may evaporate from the coating once all curing processes are complete. The percent inclusion of these components would then refer to the wet coating as applied to the styling substrate before any curing processes occur. The coating may have a surface resistivity in an amount of about $1.0*10^2$ Ohm/($cm^2$) or more, or preferably about $1.0*10^3$ Ohm/($cm^2$) or more. The coating may have a surface resistivity of about $1.0*10^6$ Ohm/($cm^2$) or less, or preferably about $1.0*10^5$ Ohm/($cm^2$) or less.

The coating may include one or more ceramic minerals which may function to harden and provide structure upon curing. The ceramic minerals may aid in bonding the coating to the styling substrate. The ceramic minerals may provide surface smoothness to the styling substrate of the hair styling device. The one or more ceramic minerals may be present in the coating in an amount of about 10 percent or more by weight, 20 percent or more by weight, or preferably 28 percent or more by weight. The one or more ceramic minerals may be present in the coating in an amount of about 70 percent or less by weight, 65 percent or less by weight, preferably 60 percent or less by weight, or more preferably 56 percent or less by weight of the total weight of the coating (i.e., in an amount of between about 28 percent by weight and 56 percent by weight). Ceramic minerals may be silica, alumina, titanium dioxide, zirconia, silicon carbide, ferrous oxide, natrium oxide, potassium oxide, calcium oxide, magnesium oxide, or mixtures thereof.

The coating may include one or more graphene materials which may function to vary the thermal conductivity of the coating. For example, as the amount of graphene added to the coating increases, the thermal conductivity of the coating may increase. The graphene materials may provide strength to the coating after all curing processes are complete. The coating may include a sufficient amount of graphene material so that the thermal conductivity of the friction material is about 3 Watts/(meter·Kelvin) or more, about 5 Watts/(meter·Kelvin) or more, even about 6 Watts/(meter·Kelvin) or more. The coating may include an amount of graphene material so that the thermal conductivity of the friction material is about 10 Watts/(meter·Kelvin) or less, preferably about 8 Watts/(meter·Kelvin) or less, more preferably about 7 Watts/(meter·Kelvin) or less. The coating may also include copper, silver, or gold nano particles or quantum dots (QDs) which may function to increase thermal conductivity. The graphene material may be in the form of a plurality of individual discrete elements (e.g. as powder particles, flakes, or other elements). The graphene material may be graphene nano platelets (GNPs), graphene quantum dots (GQDs), or a combination thereof. Examples of commercially available graphene materials are available from Angstron Materials (a division of the Global Graphene Group) under the trade names N006-P, N002-PDR, and XG Sciences Inc., under the trade names XGnP® nanoplatelets Grade C and Grade M.

The coating may include multiple different graphene nano platelets in powder form. A first graphene nano platelet may have an average specific surface area of about 300 $m^2/g$ or more, preferably 320 $m^2/g$ or more, or more preferably 340 $m^2/g$ or more. A first graphene nano platelet may have an average specific surface area of about 980 $m^2/g$ or less, preferably 970 $m^2/g$ or less, or more preferably 960 $m^2/g$ or less (i.e., in an amount of between 340 $m^2/g$ and 960 $m^2/g$). A second graphene nano platelet may have an average specific surface area of about 10 $m^2/g$ or more, preferably about 12 $m^2/g$ or more. A second graphene nano platelet may have an average specific surface area of about 20 $m^2/g$ or less, preferably about 18 $m^2/g$ or less. The graphene nano platelets may have an average thickness of about 0.6 nm or more, 0.8 nm or more, or preferably 1 nm or more. The graphene nano platelets may have an average thickness of about 35 nm or less, 30 nm or less, or preferably 24 nm or less (i.e., in an amount of between 1 nm and 24 nm). The graphene nano platelets may have an average length and width of about 2 microns or more, about 3 microns or more, or preferably about 4 microns or more. The graphene nano platelets may have an average length and width of about 18 microns or less, about 14 microns or less, or preferably about 12 microns or less (i.e., in an amount of between 4 microns and 12 microns). The graphene nano platelets may be in the form of "pristine graphene" (>97% carbon atoms), slightly oxidized graphene (5% by weight of oxygen), or graphene oxide. Preferably, the graphene nano platelets may be of a polar grade with average oxygen content in an amount of about 5.0 percent or less by weight, about 4.5 percent or less by weight, or preferably about 4.0 percent or less by weight of the total amount of graphene nano platelets. The graphene nano platelets may be present in the coating in an amount of about 1 percent or more by weight, 3 percent or more by weight, or preferably 5 percent or more by weight. The graphene nano platelets may be present in the coating in an amount of about 20 percent or less by weight, about 15 percent or less by weight, or preferably about 10 percent or less by weight of the total weight of the coating (i.e., in an amount of between about 5 percent by weight and 10 percent by weight). The graphene quantum dots may be present in the coating in an amount of about 0.2 percent or more by weight, about 0.3 percent or more by weight, or preferably 0.4 percent or more by weight. The graphene quantum dots may be present in the coating in an amount of about 20 percent or less by weight, about 15 percent or less by weight, or preferably about 12 percent or less by weight of the total weight of the coating (i.e., in an amount of between about 0.4 percent by weight and 12 percent by weight). The graphene quantum dots may also act as a pigment when present in the coating. If utilized as a pigment, the total percent by weight of the graphene quantum dots in the coating may be added to the upper limits disclosed below and may fall outside the upper limit of the range as listed above.

The coating may include one or more anti-static agents which may function to remove the positive electrostatic charge on hair by releasing negative ions. The one or more anti-static agents may assist in providing smoother hair by reducing hair static. The one or more anti-static agents may be present in the coating in an amount of about 0.2 percent or more by weight, 0.4 percent or more by weight, preferably 0.6 percent or more by weight, or more preferably 0.8 percent or more by weight. The one or more anti-static agents may be present in the coating in an amount of about 4 percent or less by weight, 2 percent or less by weight, preferably 1.6 percent or less by weight, or more preferably 1.2 percent or less by weight of the total weight of the coating (i.e., in an amount of between about 0.8 percent by weight and 1.2 percent by weight). Anti-static agents may include aluminum, brass alloy, steel alloy, or preferably tourmaline. Tourmaline may be included in the coating in the form of a crushed particles.

The coating may include one or more pigment materials which may function to alter the aesthetic appearance of the coating. The pigments may be naturally occurring, synthetic, or both. The one or more pigment materials may be present in the coating in an amount of about 4 percent or more by weight, about 6 percent or more by weight, or preferably about 8 percent or more by weight. The one or more pigment materials may be present in the coating in an amount of about 30 percent or less by weight, 25 percent or less by weight, preferably 20 percent or less by weight, or more preferably 18 percent or less by weight of the total weight of the coating (i.e., in an amount of between about 8 percent by weight and 18 percent by weight). Suitable pigment materials may include mica powder, pearlescent pigments, graphene quantum dots, various color pigments (e.g. yellow, red, black, or white pigment) or combinations thereof. It should be understood that when graphene quantum dots are used as a pigment, the overall percent of graphene material in the coating will be higher.

The coating may include one or more solvents which may function as a medium, assisting in the flow and application of the coating to the surface of the styling substrate. One or more solvents may function to dissolve or dilute the components of the coating herein mentioned. All or some coating components may dissolve in the one or more solvents. All or some of the coating components may partially dissolve in the one or more solvents. All or some of the coating components may remain substantially in particulate form. All or some of the coating components may be diluted by the one or more solvents. The one or more solvents may evaporate from the coating once all curing processes are complete. The one or more solvents may be present in the wet coating in an amount of about 15 percent or more by weight, 20 percent or more by weight, or preferably 24 percent or more by weight. The one or more solvents may be present in the wet coating in an amount of about 65 percent or less by weight, 60 percent or less by weight, or preferably 54 percent or less by weight of the total weight of the coat in a wet state (i.e., in an amount of between about 24 percent by weight and 54 percent by weight). Preferably, the one or more solvents evaporates during the curing process. Suitable solvents may include water, alcohols (e.g. isopropyl alcohol), methyl ethyl ketone, acetone, or combinations thereof.

FIG. 1 illustrates a hair styling device 2 that is a round brush 4. The round brush 4 includes a handle portion 20 and a barrel portion 32 attached to the handle portion 20 at one end and extending longitudinally therefrom. The barrel portion 32 includes a plurality of holes 44. A plurality of bristles 46 extend and radiate outwardly through the plurality of holes 44. A conductive coating 70 is disposed on the surface of the barrel portion 32 of the round brush 4.

Figure 2:
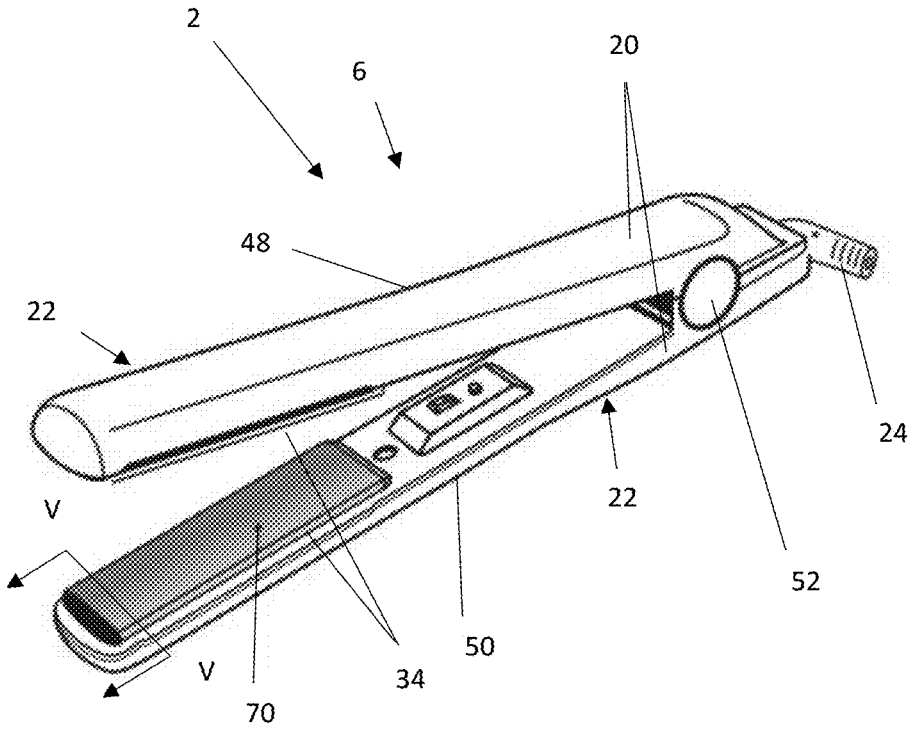
FIG. 2 is a perspective view of a flat iron with a coating disposed on the heating member thereof.

FIG. 2 illustrates a hair styling device 2 that is a flat iron 6. The flat iron 6 includes a first arm 48 and a second arm 50 connected together via a hinge 52 at one end. The first arm 48 and the second arm 50 of the flat iron 6 are covered by a respective housing 22 and include a handle portion 20 proximate to the hinge 52. An electrical cord 24 extends from the end of the handle portion 20 and has a plug (not shown) to connect to an electrical energy source (not shown). Each of the first arm 48 and the second arm 50 include a heating member 34. A conductive coating 70 is disposed on the heating members 34 of the flat iron 6.

Figure 3:
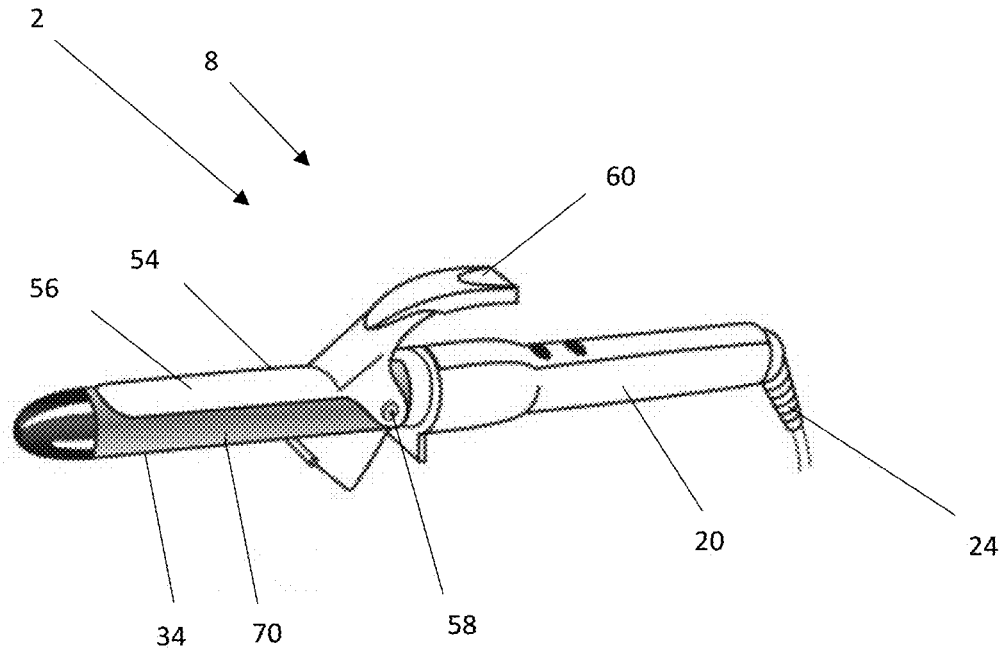
FIG. 3 is a perspective view of a curling iron with a coating disposed on the heating member thereof.

FIG. 3 illustrates a hair styling device 2 that is a curling iron 8. The curling iron 8 includes a handle portion 20 and a heating member 34 attached to the handle portion 20 at one end and extending longitudinally therefrom. An electrical cord 24 extends from the end of the handle portion 20 distal to the heating member 34 and has a plug (not shown) to connect to an electrical energy source (not shown). The heating member 34 includes a movable hair-securing clamp 54. The base 56 of the hair-securing clamp 54 has a curved shape which corresponds to the outer surface of the heating member 34 and is secured at one end via a pivot pin 58. A thumb rest 60 extends upwardly from the base 56 of the hair-securing clamp 54 to move the base 56 of the hair-securing clamp 54 in a position away from the heating member 34 when depressed. A conductive coating 70 is disposed on the surface of the heating member 34 of the curling iron 8.

Figure 4:
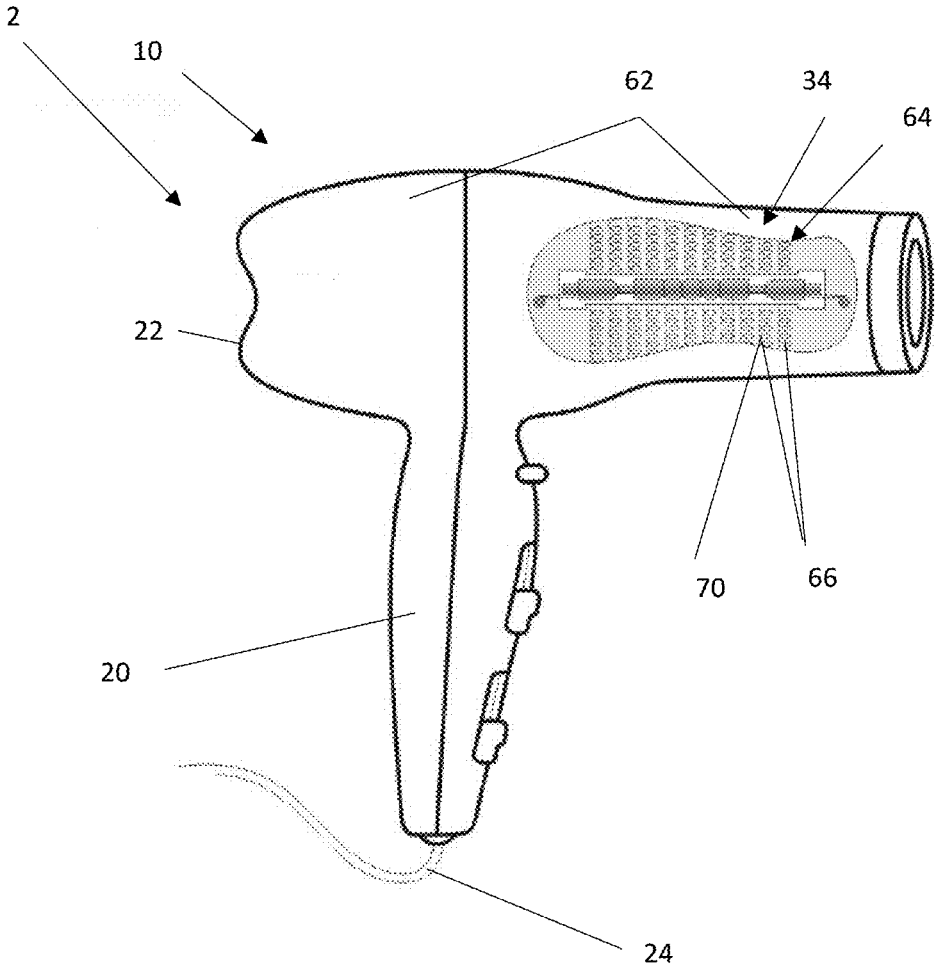
FIG. 4 is a partially sectioned side view of a blow dryer with a coating disposed on the heating coils thereof.

FIG. 4 illustrates a hair styling device 2 that is a blow dryer 10. The blow dryer 10 includes a housing 22. The housing 22 comprises a handle portion 20 and a head portion 62. An electrical cord 24 extends from the end of the handle portion 20 and has a plug (not shown) to connect to an electrical energy source (not shown). The head portion 62 of the housing 22 encloses a heating member 34 that is a heating element 64. The heating element 64 includes a plurality of heating coils 66. A conductive coating 70 is disposed on the surface of the heating coils 66 of the blow dryer 10.

Figure 5:
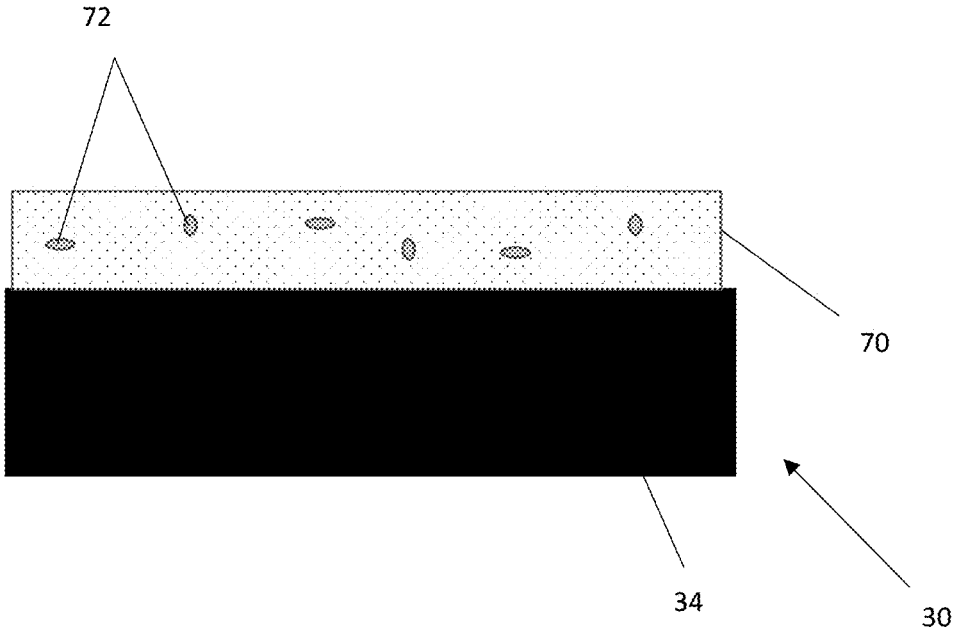
FIG. 5 is a cross-sectional view of a styling substrate of FIG. 2 cut along line V-V.

FIG. 5 illustrates a cross-sectional view of a styling substrate 30 of FIG. 2 cut along line V-V. A conductive coating 70 is disposed on the styling substrate 30 which is a heating member 34. Dispersed within the conductive coating 70 is one or more graphene materials 72.

Examples

| | A | B | C | D | E | F | G | H | I | J |
|---|---|---|---|---|---|---|---|---|---|---|
| Silica | 26 | 27 | 28 | 30 | 27 | 32 | 36 | 33 | 28 | 27 |
| Zirconia | 5 | 6 | 5 | 5 | 7 | — | — | 5 | 6 | 7 |
| Alumina | 4 | — | 5 | — | 5 | 5 | — | — | — | — |
| Graphene Nano Platelets | 5 | 5 | 6 | 6.5 | 6 | 6 | 5.5 | 5 | 7 | 8 |
| Graphene Quantum Dots | 0.5 | 0.6 | 1 | .5 | — | 1 | — | 1 | 0.5 | 0.5 |
| Tourmaline | 1 | 1 | 0.8 | 1 | 1 | 1 | 0.8 | 1.2 | 1 | 1.2 |
| Acetone | — | 9 | 8 | — | — | 10 | 18 | — | 25 | — |
| Isopropyl Alcohol | 15 | 15 | 18 | 20 | 20 | 18 | — | 17 | 13 | 25 |
| Water | 20 | 16 | 15 | 15 | 15 | — | 17 | 20 | 15 | 17 |
| Inorganic Pigment Black | 10 | 8 | 9 | 8 | 9 | 9 | 8 | 9 | 10 | 8 |
| Inorganic Pigment White | — | 5 | 2 | 3 | 3 | 2 | — | 3 | — | 5 |
| Mica Powder | 2 | — | 1 | — | 1 | — | — | 1 | 1 | 2 |

*All of the values in the table are weight percent unless otherwise stated.

The above are tested for meeting the following requirements: (1) thermal conductivity and (2) surface resistivity.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01, or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the of a range in terms of "at least 'x' parts by weight of the resulting composition" also contemplates a teaching of ranges of same recited amount of "x" in percent by weight of the resulting composition."

The components express their composition in a percent by weight. Even through the compositions do not express a relative ratio between components such ratios are within the scope of the teachings. By way of example, if element A is in an amount of about 10 percent by weight and element B is in an amount of about 2 percent by weight of the total composition the teachings herein contemplate a ratio of about 5:1 for A to B. Unless otherwise described, it should be understood that all listed percentages are given in their dry weight and refer to the solid coating formed on the styling substrate of the hair styling device. Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist of, or consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

I claim:

1. A hairstyling device comprising:

a styling substrate; and a coating disposed onto the styling substrate, the coating including:

one or more ceramic minerals, and one or more graphene materials including graphene nano platelets;

the graphene nano platelets including a combination of a first graphene nano platelet having an average specific surface area of between 300 $m^2/g$ and 980 $m^2/g$ and a second graphene nano platelet having an average specific surface area of between 10 $m^2/g$ and 20 $m^2/g$ in a sufficient amount so that the coating has a thermal conductivity of about 7 Watts/(meter*Kelvin).

2. The hair styling device of claim 1, wherein the one or more graphene materials includes graphene quantum dots.

3. The hairstyling device of claim 2, wherein the graphene quantum dots are present in an amount from about 0.4 weight percent to about 12 weight percent of the coating.

4. The hair styling device of claim 1, wherein the graphene nano platelets have a thickness in the range of between 1 nm to about 24 nm.

5. The hair styling device of claim 4, wherein the graphene nano platelets are present in an amount from about 5 weight percent to about 10 weight percent of the coating.

6. The hairstyling device of claim 1, wherein the coating further includes one or more anti-static agents.

7. The hairstyling device of claim 6, wherein the anti-static agent includes tourmaline.

8. The hairstyling device of claim 1, wherein the coating further comprises one or more pigment materials.

9. The hair styling device of claim 1, wherein the ceramic mineral comprises one or more substances selected from the group consisting of silica, alumina, titanium dioxide, zirconia, silicon carbide, ferrous oxide, natrium oxide, potassium oxide, calcium oxide, magnesium oxide, or mixtures thereof.

10. The hair styling device of claim 1, wherein the ceramic mineral is present in an amount of from about 28 weight percent to about 56 weight percent of the coating.

11. The hair styling device of claim 1, wherein the coating disposed onto the styling substrate is in direct or indirect contact with hair.

12. The hair styling device of claim 11, wherein the indirect contact with hair involves a means for moving air across the styling substrate that is a heating element, wherein the heating element heats the air and the heated air contacts hair.

13. The hair styling device of claim 1, wherein the coating has a thickness in the range of between 30 microns to about 90 microns.

14. The hair styling device of claim 1, wherein the graphene nano platelets have an average oxygen content in an amount of about 5.0 percent or less by weight.

15. The hair styling device of claim 1, wherein the graphene nano platelets have an average length and width between 2 microns and 14 microns.

16. The hair styling device of claim 1, wherein the graphene nano platelets are in powder form.

17. A hairstyling device comprising:

a styling substrate; and a coating disposed onto the styling substrate, the coating including:

a) one or more ceramic minerals, wherein the ceramic mineral comprises one or more substances selected from the group consisting of silica, alumina, titanium dioxide, zirconia, silicon carbide, ferrous oxide, natrium oxide, potassium oxide, calcium oxide, magnesium oxide, or mixtures thereof;

b) one or more graphene materials including graphene nano platelets comprised of a combination of a first graphene nano platelet having an average specific surface area of between 300 $m^2/g$ and 980 $m^2/g$ and a second graphene nano platelet having an average specific surface area of between 10 $m^2/g$ and 20 $m^2/g$ present in a sufficient amount so that the coating has a thermal conductivity of about 7 Watts/(meter*Kelvin);

c) one or more anti-static agents; and d) one or more pigment materials.

18. The hair styling device of claim 17, wherein the graphene nano platelets have a thickness in the range of between 1 nm to about 24 nm.

19. The hair styling device of claim 18, wherein the graphene nano platelets are present in an amount from about 5 weight percent to about 10 weight percent of the coating.

20. A hair styling device comprising:

a styling substrate; and a coating disposed onto the styling substrate, the coating including:

a) one or more ceramic minerals, wherein the ceramic mineral comprises one or more substances selected from the group consisting of silica, alumina, titanium dioxide, zirconia, silicon carbide, ferrous oxide, natrium oxide, potassium oxide, calcium oxide, magnesium oxide, or mixtures thereof;

b) one or more graphene materials including graphene nano platelets comprised of a combination of a first graphene nano platelet having an average specific surface area of between 300 $m^2/g$ and 980 $m^2/g$ and a second graphene nano platelet having an average specific surface area of between 10 $m^2/g$ and 20 $m^2/g$ in a sufficient amount so that the coating has a thermal conductivity of about Watts/(meter*Kelvin);

c) one or more anti-static agents; and d) one or more pigment materials; wherein the coating is disposed onto a heating member or a hair brush.

* * * * *